US005600362A

United States Patent [19]

Morgavi et al.

[11] Patent Number: 5,600,362

[45] Date of Patent: Feb. 4, 1997

[54] AUTOMATIC SYSTEM FOR FRONT-AND-BACK PRINTING OF CARDS IN BLACK AND WHITE AND IN COLOR, BY REVERSING THE CARD

[75] Inventors: Paul Morgavi, la Ciotat; Jean-Paul Marietti, Mimet; Jean-Jacques Oubrayrie, Allauch, all of France

[73] Assignee: Gemplus Card International, Gemenos, France

[21] Appl. No.: 426,764

[22] Filed: Apr. 13, 1995

[30] Foreign Application Priority Data

Apr. 15, 1994 [FR] France ..... 94 04827
Apr. 15, 1994 [FR] France ..... 94 04828

[51] Int. Cl.[6] ..... B41J 2/325

[52] U.S. Cl. ..... 347/218

[58] Field of Search ..... 347/215, 218, 347/171, 172, 174, 176; 346/134, 136; 355/23, 24, 26; 400/120.01

[56] References Cited

U.S. PATENT DOCUMENTS 4,857,941 8/1989 Kaida ..... 347/218
4,903,043 2/1990 Tajima ..... 347/134
5,266,969 11/1993 Mochizuki .

FOREIGN PATENT DOCUMENTS 445035 6/1927 Germany .
3704059 8/1988 Germany .
830211382 11/1983 Japan .
880313306 12/1988 Japan .
900110434 4/1990 Japan .
900263585 10/1990 Japan .
910183764 6/1991 Japan .
920089774 10/1993 Japan .

*Primary Examiner*—Huan H. Tran
*Attorney, Agent, or Firm*—Pollock, Vande Sande & Priddy

[57] ABSTRACT

The invention concerns automatic systems for printing both sides of cards in black and white and in color. It comprises a black-and-white printing machine next to a color printing machine, each machine incorporating a thermal printing head, in front of which travel simultaneously a ribbon holding colorants to be deposited and the card to be printed, and at least one card-reversing device placed before or after a machine. The invention can be used for bank card printers.

8 Claims, 4 Drawing Sheets

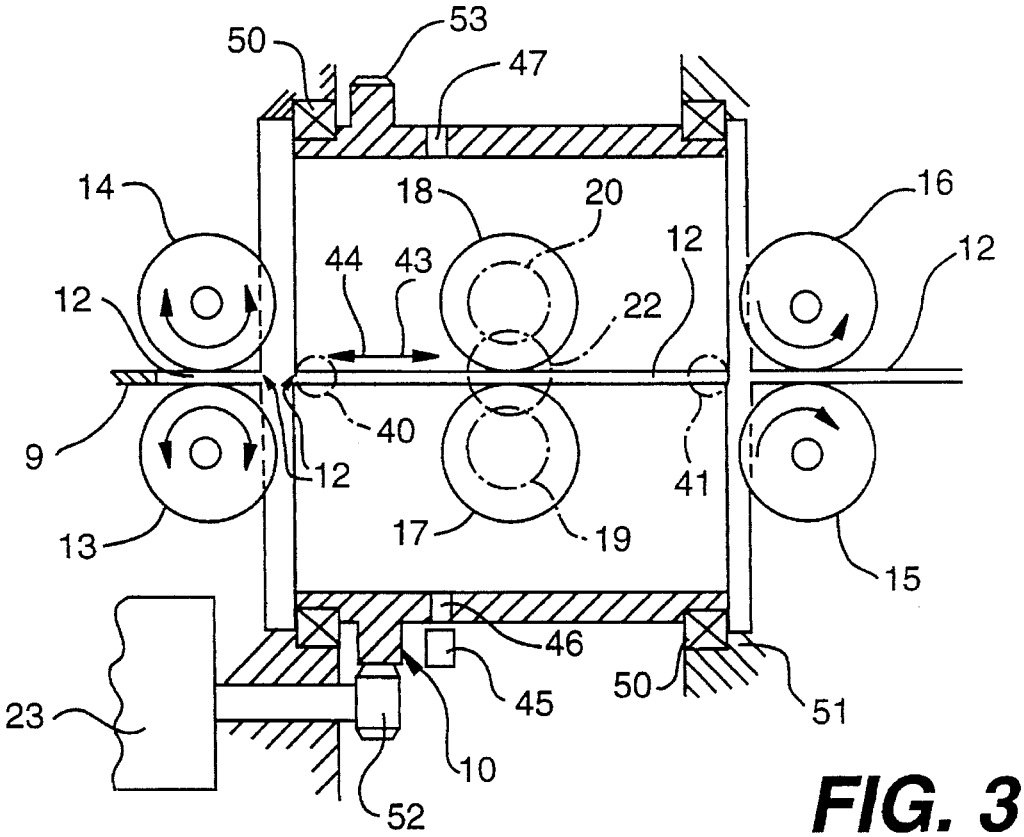
FIG. 3
FIG. 4
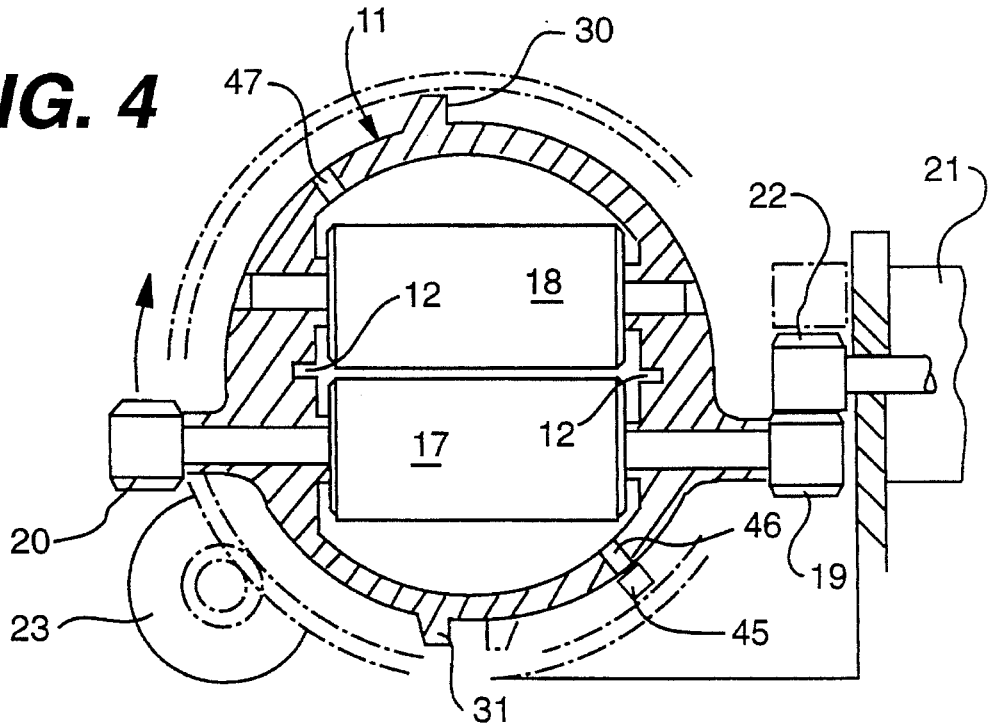

AUTOMATIC SYSTEM FOR FRONT-AND-BACK PRINTING OF CARDS IN BLACK AND WHITE AND IN COLOR, BY REVERSING THE CARD

FIELD OF THE INVENTION

The present invention concerns a system for the front-and-back printing of cards in black and white and in color, by reversing the card.

BACKGROUND OF THE INVENTION

Conventional practice encompasses a heat-transfer technology, in which the colorant is not sprayed, but deposited and fixed on a surface to be printed, by means of resistors incorporated into a thermal printing head which heats a ribbon coated with colorants by using a modulated electric current.

The conventionally-used machines which implement this technology generally print either in black and white or in color, by effecting a first run when the front of the card is printed and a second run with the card reversed to print the back side, after the machine has been reprogrammed. This type of machine is slow and requires intermediate manual operations.

BRIEF DESCRIPTION OF THE INVENTION

The present invention is intended to produce an automatic machine permitting faster printing rates in black and white and in color on both sides, without manual intervention.

The invention relates to an automatic system for the front-and-back printing of cards in black and white or in color, comprising:

at least one black-and-white or color printing machine incorporating a thermal printing head, in front of which pass simultaneously a ribbon serving as a support for the colorants to be deposited and the card to be printed;

at least one card-reversing device positioned before or after said printing machine;

a device controlling the printing machine and the reversing device, which moves the card in front of the thermal head so as to bring the front side in contact with said ribbon for printing of this front side; reverses this card in the reversing device; and brings the back side of the card in contact with said ribbon for printing of this back side, characterized by the fact that the card-reversing device is a rotating device incorporating:

- a horizontal drum which can pivot +/−180° around its horizontal axis, in which the card is inserted flat and on one side or the other along one axis of the card by means of rollers turning in opposite directions, this drum comprising rollers which move the card in the flat position inside the drum,
- a motorized device which drives the horizontal drum in a +/−180° rotation around an axis,
- a device controlling the position of the card in the drum before rotation is initiated, and
- device for continuous tracking of the direction, whether front or back side, of the card in the drum.

Other features and advantages of the invention will emerge from a reading of the following detailed description provided with reference to the attached drawings, in which:

BRIEF DESCRIPTION OF THE FIGURES

FIG. 3 is a vertical cross-section of the card-reversing device illustrating the longitudinal dimension of card insertion;

FIG. 4 is a vertical cross-section of the card-reversing device illustrating the transverse dimension of card insertion.

DETAILED DESCRIPTION OF THE INVENTION

Figure 1:
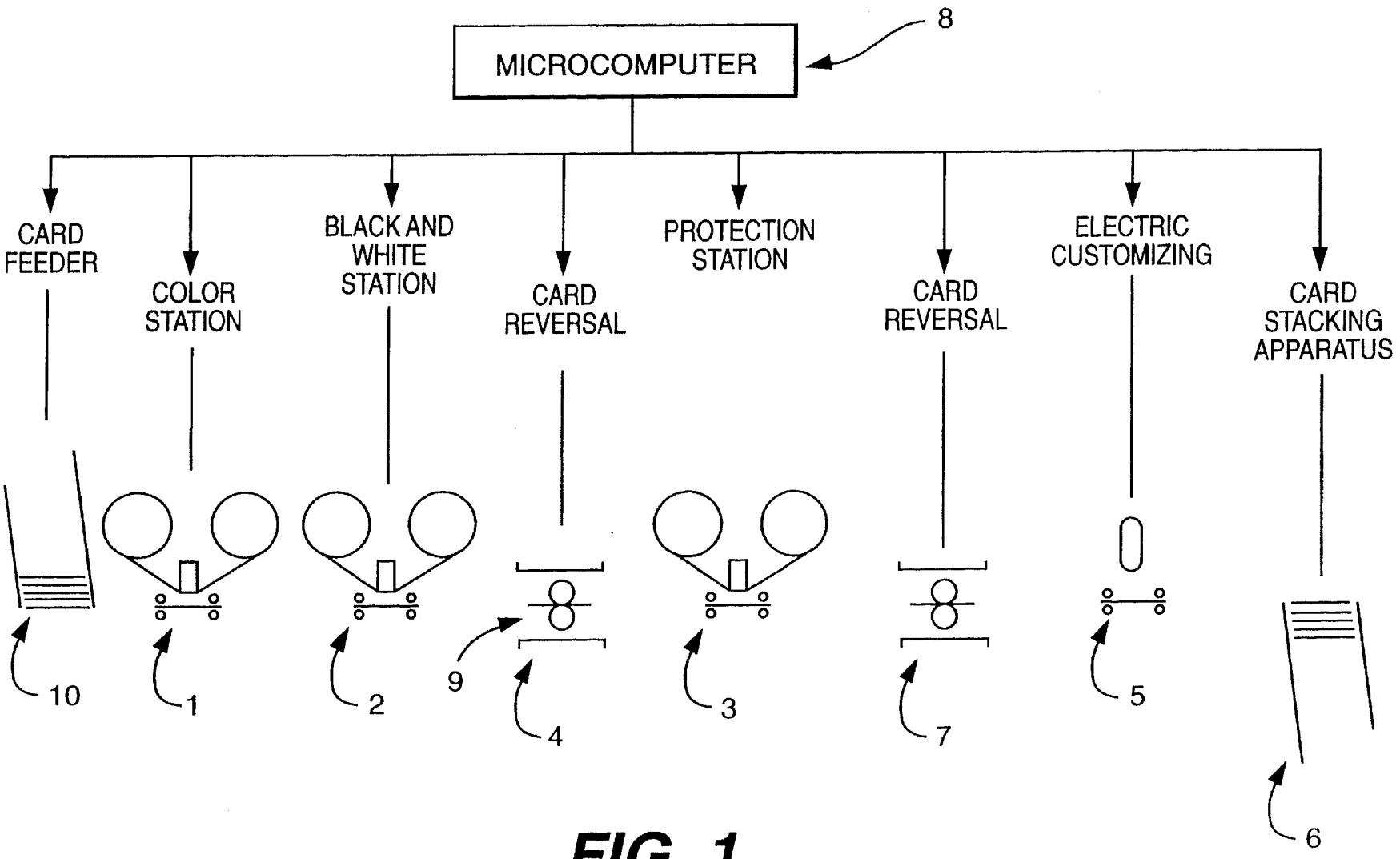
FIG. 1 illustrates one way to organize the various work stations belonging to the automatic front-and-back printing system according to the invention.

A printing machine according to the invention comprises the following components arranged in order (FIG. 1):

a feeder 10 of the cards 9 to be printed;

a color-printing station 1;

a black and white printing station 2;

a first card-reversing device 4;

a station 3 at which a protective coating is deposited;

a second reversing device 7;

an electric customizing device 5;

a printed card-stacking device 6, and a microcomputer 8 which controls components 1 to 7 and 10.

Of course, these various elements can be arranged in a different order; alternatively, only some of these components may be used or positioned, depending on the nature of the final printing. The feeder 10 is a conventional device holding approximately 200 cards and comprising a safety system which prevents double feeding and a system which triggers card entry, depending on the availability of the color station 1.

The color-printing station 1, the black and white printing station 2, and the protective film station 3 are of the type described in U.S. Pat. No. 9,402,116 filed by the Applicant on Feb. 24, 1994, entitled "Color Printing Machine." This machine incorporates the following elements:

- a ribbon which holds colorants, substances, and films arranged in sequential order and incorporates marks between the sequences of colorants, substances or films, and separators between the colorants, substances, or films,
- a thermal printing head allowing transfer of a colorant, substance or film from the ribbon to a card,
- a first motorized apparatus used to position the ribbon beneath the thermal printing head,
- a second motorized apparatus used to position the card to be printed beneath the thermal printing head and the ribbon,
- a third motorized apparatus which moves the thermal printing head closer to, or farther away from, the card,
- a first detection device which detects the separators and marks during ribbon travel,
- a second detection device used to detect the entry and exit of the card beneath the thermal printing head,
- a third detection device used to detect the position of the thermal printing head, and a control system, including the first, second, and third detection devices and designed to control the first, second, and third motorized apparatuses so as to position the card to be printed beneath the thermal printing head as many times as there are colorants, substances, and films contained in the sequence on the ribbon.

Of course, machines 1, 2 and 3 in FIG. 1 may exhibit significant differences from one to the other, in particular as regards the ribbon and control system; however, their underlying principle and embodiments are similar.

Figure 2:
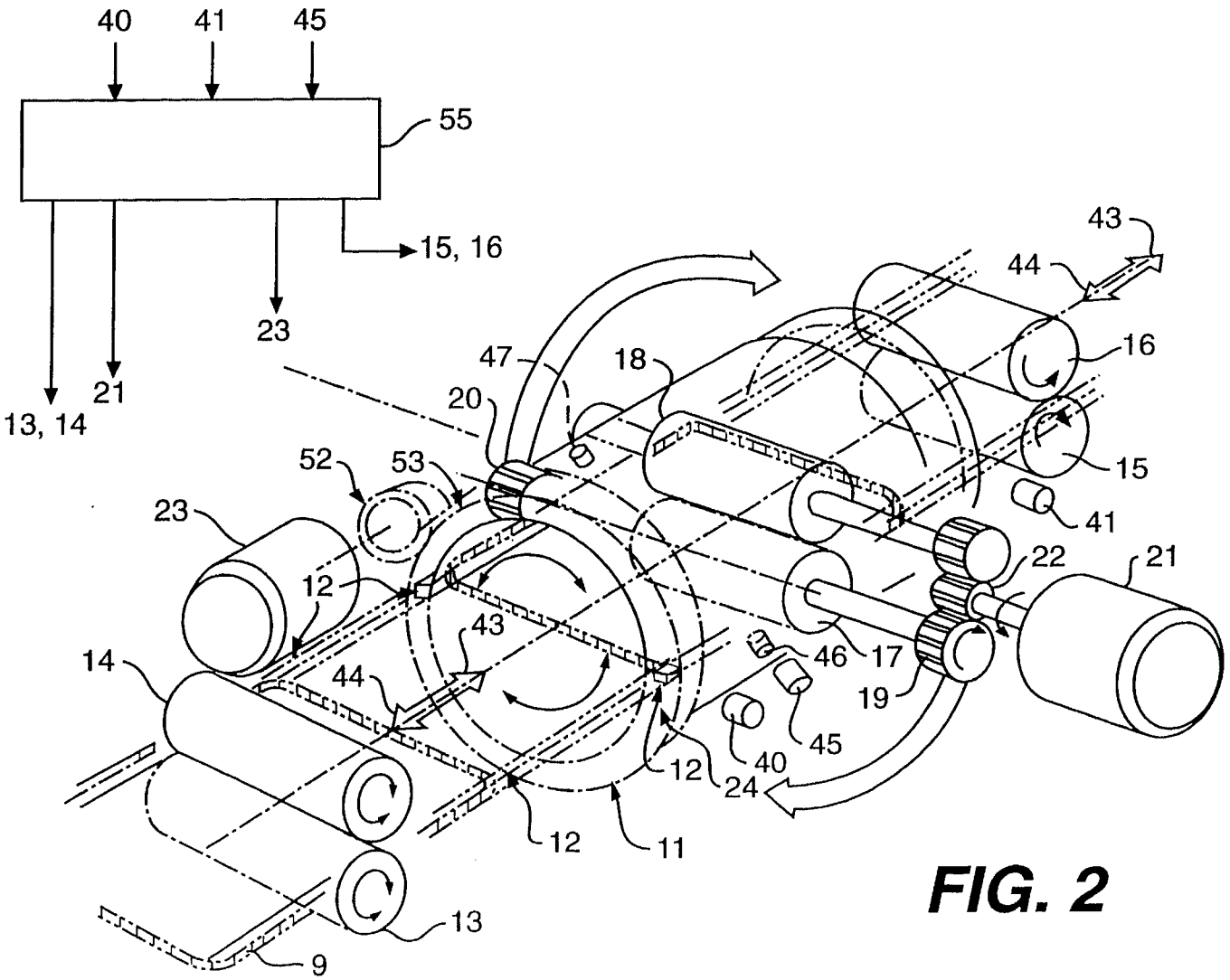
FIG. 2 is a simplified diagram of a card-reversing device.

Each reversing device 4 or 7 (FIGS. 2, 3, and 4) comprises a horizontal drum 11, into which the card 9 is fed flat and in which it is guided lengthwise in an travel groove 12. This drum rotates by +/−180° around its horizontal axis by means of bearings 50 supported on a frame 51. The drum 11 is driven in rotation by a motor 23, whose output shaft supports a pinion which meshes with a toothed wheel 53 fastened to the drum.

Rollers 13, 14, 15, and 16 control the movement of the card 9 as it is inserted in the drum and, next, after reversal, as it travels to another work station located before or after the drum. These rollers are driven in rotation by motorized means (not shown). Other rollers 17, 18 provide for travel of the card inside the drum.

The distance between the rollers 13, 14 and 17, 18, on the one hand, and the rollers 16, 17 and 17, 18, on the other, respectively, is less than the length of one card, with the result that a card entering or exiting the reversing device is successively pushed and pulled by two pairs of rollers, in whatever direction it travels. The drive roller 17 is equipped with a pinion 19, 20 at each end, which projects outward from the drum. A stationary motor 21, whose drive pinion 22 falls within the same plane as the end pinions, interlocks in alternating fashion with either of the end pinions, depending on the position of the drum after rotation.

During internal transport of the card effected by the rollers 17, 18 and to prevent the pinions 19 or 20 from uncoupling from the drive pinion 22, the reversing motor 23 is powered so as to produce resisting torque when the motor 21 is started up and until the end of card travel.

The entry and exit of the card 9 into and out of the drum 11 is detected by two optical devices 40, 41, e.g. two photoelectric cells, each of which is placed at one end and on the outside of the drum. The rotation of the drum 11 is detected by an optical device comprising a photoelectric cell 45 which works in conjunction with two diametrically opposite holes 46 and 47 in the rim of the drum 11.

After detection of card insertion into the drum in direction 43 or direction 44, the passage of certain interval, and lack of detection of the exit of a card in one direction or the other, the card is known to be in the drum and rotation can be started.

Before actuating the command to initiate rotation of the motor 23, the initial position of the drum is checked by passing through the hole 46 a light beam emitted by an emitter (not shown) and detected by the photoelectric cell 45. After passage of an interval shorter than the rotation time, the screening of the photoelectric cell 45 by the rotation of the drum cover is checked. After the passage of an interval greater than the time of rotation, a light beam is emitted, this time through the hole 47; this light beam, detected by the cell 45, verifies the 180° rotation of the drum. The reversing motor 23 drives the drum in rotation by +/−180° in relation to an initial horizontal position of the card-insertion groove 24, thereby reversing the card around its large axis.

The drum is fitted with recognition means 30, 21 directly visible to the operator, which indicate the attitude of the card inside the drum, i.e., whether the front or back is exposed.

A microprocessor-type electronic control device 55 receives the signals emanating from the detection devices 40, 41, and 45 and produces signals which control the motors 21, 23 and the motorized mechanisms (not shown) driving the rollers 13 to 16.

The card 9 is fed into the drum 11 by means of exterior rollers 13, 14 on one side, and 15, 16 on the other, in a flat position along its large axis. The card is gripped by the interior rollers 17, 18, which take over from the exterior transport rollers positioned at a distance of less than one card-length.

When the card is entirely enclosed inside the drum, the interior rollers stopped and the card position verified, the reversing motor 23 is actuated in order to turn the drum 180° in either direction.

At the end of the rotation, one of the two pinions 19, 20 located at the ends of the shaft of the interior motorized roller meshes with the pinion 22 belonging to the motor 21, which, actuated in one direction or the other, makes it possible to transport the card downstream or upstream from the drum 11.

The reversed card is gripped by the exterior travel rollers 13 to 16 positioned at a distance of less than one card-length from the interior rollers 17, 18. The card is thus transported to another work station, either upstream or downstream from the drum.

The electric customizing station 5 is a conventional one. It is compatible with all types of integrated circuits or electronic chips sold on the market. This station 5 is intended to customize the integrated circuit preliminarily placed in a recess in the card, for example to record a secret code which the future user of the card alone will know.

The conventionally-known stacking device 6 has a capacity least equal to that of the feeder 10.

The microcomputer 8 controls the various components of the printing system in FIG. 1 by means of interface circuits, each of which is linked to one component and may comprise a microprocessor.

In the case of machines 1, 2, and 3, this microprocessor also operates the control system based on the data supplied by the detection means.

The systems controlling the printing machines and the reversing devices renew their data from sensors placed at the inputs and outputs of these components and, depending on the availability of the printing heads, feed cards to the latter either from the feeder, to effect printing of the front side, or from a reversing device, to effect printing of the back side. Following the graphic customizing operations, which include the use of a special film to protect the printed surfaces, the microcomputer 8 sends the card to the electric customizing station.

Figure 5:
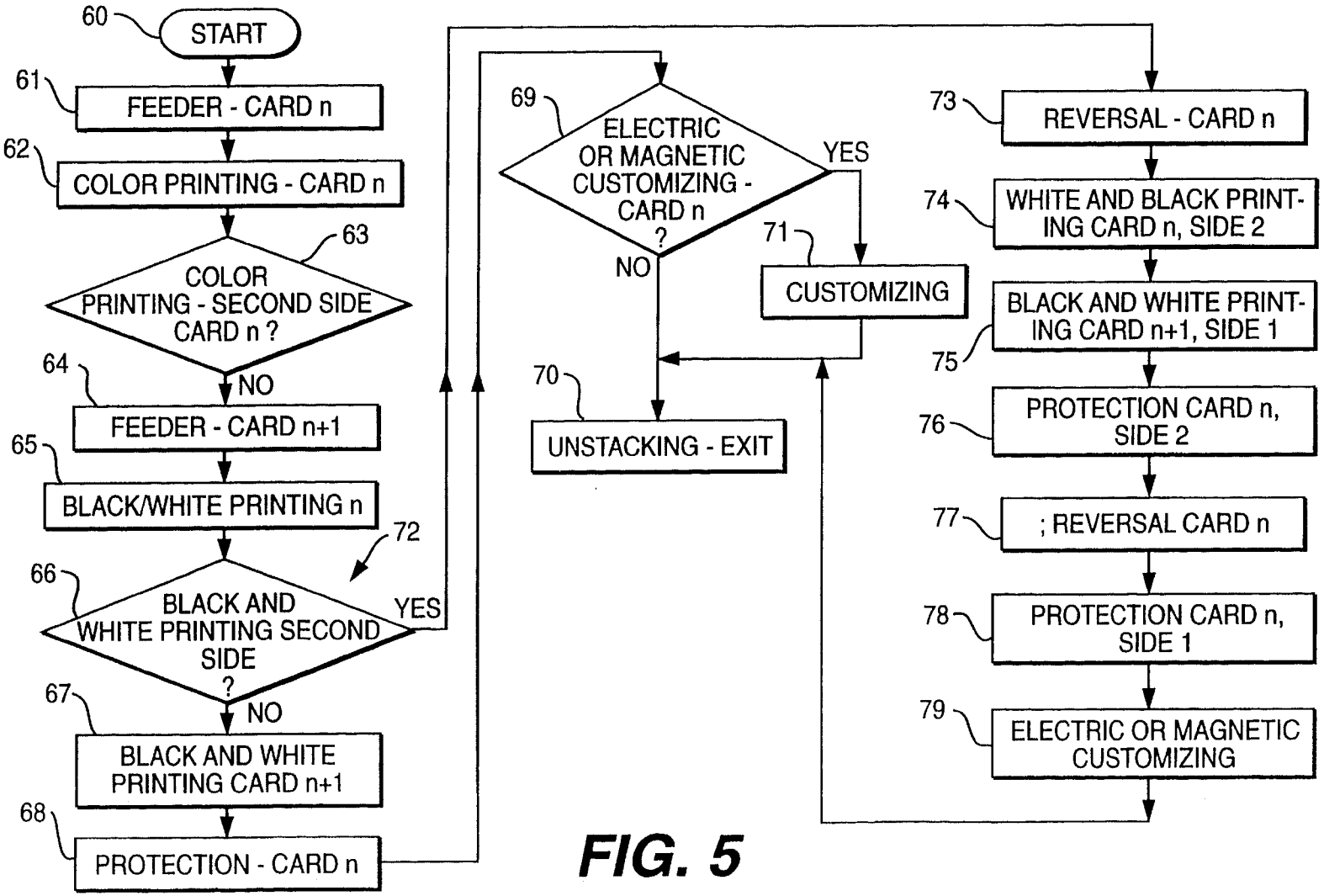
FIG. 5 is a diagram illustrating the subsequent operations performed by the printing system according to the invention.

The microcomputer 8 uses software specifically designed to perform the various operations, such as those enumerated in FIG. 5.

These operations (FIG. 5) include:

a command 60 for triggering the start of operation of the printing system;

the order 61 to feed the card "n" into the color-printing station 1;

accomplishment 62 of the color printing of all or a portion of the first side of card "n" by the color-printing station 1;

the decision 63 to print or not to print in color the second side of card "n";

if the decision 63 is negative, the color station 1 is free, and the order 64 to feed the card n+1 is carried out;

accomplishment 65 of the black-and-white printing of the areas of the first side of the card "n" by the black-and-white printing station 2;

the decision to print or not to print in black and white the second side of the card "n";

if the decision 66 is negative, the order 67 is given to print in black and white all or a part of the card "n+1" by means of the black-and-white printing station;

the order 68 is then given to the protection station 3 to protect the card "n";

the decision 69 to customize card "n" electrically or magnetically;

if the decision 69 is negative, the order 70 is given to send the card "n" to the stacking device 6;

if the decision 69 is affirmative, the order 71 is given to send the card to the electric customizing station 5;

after electric customizing of the card "n," the card is sent to the stacking device 6 by means of command 70.

The operations just described are performed in consequence of the negative decision 66. In the event of an affirmative decision 72, the following steps are performed in succession:

the order 73 to reverse the card "n" by means of the reversing device 4;

accomplishment 74 of the black-and-white printing of all or a portion of the second side of the card "n" by the black-and-white printing station 2;

accomplishment 75 of the black-and-white printing of all or a portion of the first side of the card "n+1" by the black-and-white printing station 2. In fact, in this loop, the card "n+1" does not undergo operation 67;

order 76 is given to protect the second side of the card "n" by means of the protection station 3;

order 77 is given to reverse the card "n" by the reversing device 7 after reversal;

order 78 is given to protect the first side of the card "n" by the protection station 3;

electric or magnetic customizing 79 of the card "n" by printing in black and white on its second side;

following electric or magnetic customizing, the card "n," which is printed in black and white on its second side, is sent to the stacking device 6 by virtue of command 70.

A safety unit permits the use of the printing system only after insertion and microcomputer 8 verification of an access-granting card prohibiting the use by an unauthorized person.

After insertion and verification of his/her access-granting card, the operator loads the feeder 10 with cards to be printed and, using the microcomputer 8, begins a specific program for printing and customizing of the cards. This special program is implemented by the various systems described with respect to FIG. 1 and according to a process described with respect to FIG. 5.

In the various stations, the control systems control the travel and presence of the cards at the various work stations. The stations feed back error messages to the microcomputer 8 in the event of malfunction of any component of the printing system, e.g., mechanical jamming of a card, anomalies on the printing head as a result of heat transfer, defects in a reversing device, etc. Each basic operation is monitored, and a message or automatic shutdown is triggered, depending on the magnitude of the malfunction.

We claim:

1. Automatic system for the front-and-back printing of cards, comprising:

at least one printing machine incorporating a thermal printing head, in front of which pass simultaneously a ribbon serving as a support for colorants to be deposited and the card to be printed;

at least one card-reversing device positioned before or after said printing machine; and an electronic device controlling the printing machine and the reversing device, which moves the card in front of the thermal head so as to bring the front side in contact with said ribbon for printing of the front side, reversing the card in the reversing device, and bringing the back side of the card in contact with said ribbon for printing of the back side, the card-reversing device being a rotating device incorporating -

(a) a horizontal drum which can pivot +/−180° around its horizontal axis, in which the card is inserted flat on one side along an axis of the card by means of rollers turning in opposite directions, said drum comprising rollers which move the card in the flat position inside the drum;

(b) a motorized device which produces a rotation of +/−180° of the horizontal drum around an axis;

(c) a device controlling the position of the card in the drum before rotation is initiated; and (d) a device for continuous tracking of the attitude of the card in the drum regardless of which side is being printed.

2. Printing system according to claim 1, wherein said tracking device comprises a photoelectric cell placed in a predetermined position in relation to the periphery of said drum and two diametrically opposite holes drilled in the drum, said photoelectric cell working in conjunction with said holes, in such a way that detection of the coincidence of a hole with the photoelectric cell corresponds to a horizontal position of the card in the drum, said photoelectric cell supplying an electric signal to said electronic control device in order to halt rotation of said drum.

3. Printing system according to claim 1, wherein at least one of said rollers moving the card in the flat position inside said drum comprises a plurality of pinions at each end, and wherein the motorized device driving the drum in rotation is provided to apply a torque holding one of said pinions in place on a further pinion belonging to a motor during translational movement of said card in said drum.

4. Printing system according to claim 1, wherein said drum comprises visual means for enabling a user to track the position of said drum.

5. Automatic front-and-back printing system according to claim 1, wherein said system incorporates two printing machines, one for color and the other for black and white, placed side by side, said reversing device being positioned after said printing machines and said control device being provided to return the card just printed on the front side to the entry of said printing machines and to cause the card to travel once again in front of said thermal printing heads while bringing the back side thereof into contact with the ribbon belonging to each machine.

6. Printing machine according to claim 5, wherein said system further comprises:

a machine which deposits a protective film, positioned after said reversing device;

a second reversing device positioned after said protective film-deposition machine;

said electronic control device being provided to move the card printed on the front and back sides in said machine, in order to deposit the protective film on one side of said card, to reverse said card in the second reversing device, to return said card to the entry of said protective film-deposition machine, and to cause said card to travel in said protective film-deposition machine while bringing the other side into contact with the protective film.

7. Printing system according to claim 6, wherein, in the event that the card to be printed incorporates an integrated circuit designed to be arranged in a recess in the card, said system further incorporates a machine designed for the electric or magnetic customizing of the integrated circuit housed in said recess.

8. Printing system according to claim 1, wherein said system further comprises an automatic card feeder positioned at the system entry, and a stacking device placed at the system exit.

* * * * *